US007513950B2

(12) United States Patent
Yasoshima

(10) Patent No.: US 7,513,950 B2
(45) Date of Patent: Apr. 7, 2009

(54) VERTICAL STAMP PAD

(75) Inventor: Ryo Yasoshima, Tokyo (JP)
(73) Assignee: Tsukineko Co., Ltd., Tokyo (JP)

( * ) Notice: Subject to any disclaimer, the term of this patent is extended or adjusted under 35 U.S.C. 154(b) by 348 days.
(21) Appl. No.: 11/347,012
(22) Filed: Feb. 3, 2006
(65) Prior Publication Data
US 2007/0144429 A1 Jun. 28, 2007
(30) Foreign Application Priority Data
Dec. 26, 2005 (JP) ..... 2005-372717
(51) Int. Cl.
*B05C 17/12* (2006.01)
(52) U.S. Cl. ..... 118/264; 101/98; 101/108; 101/333
(58) Field of Classification Search ..... 118/100, 118/264; 101/333, 98, 104; 401/131; 248/146, 248/147, 151
See application file for complete search history.

(56) References Cited

U.S. PATENT DOCUMENTS 2,521,286 A * 9/1950 Delore ..... 101/405
3,719,140 A * 3/1973 Hammel ..... 101/125
5,105,738 A * 4/1992 Mehaffey ..... 101/333
* cited by examiner

*Primary Examiner*—Laura Edwards
(74) *Attorney, Agent, or Firm*—Seed IP Law Group PLLC

(57) ABSTRACT

A stamp pad is composed of a main body and a cover, and has two legs on a side portion of the main body for standing the stamp pad upright. Said main body and cover can be separated from each other. Said legs support the main body to keep it standing upright, and the cover is fitted to the main body. Said stamp pad can stand obliquely. When said stamp pad is stood upright, the angle between the bottom of the main body and the plane on which the legs rest can be in the range of 75-85°. When the stamp pad is to be used, it is laid down. When it is not in use, the stamp pad can be stood upright.

4 Claims, 2 Drawing Sheets

VERTICAL STAMP PAD

BACKGROUND OF THE INVENTION

1. Field of the Invention

The present invention pertains to a stamp pad that can be stood upright.

2. Description of the Related Art

In the prior art, a stamp pad is widely used for applying stamp marks using a rubber stamp. The stamp pad is composed of a main body having an ink-absorbent member in it, and a cover, and there are various types with different sizes and shapes.

Among these, there is a type of stamp pad that has the main body and the cover separate and that can be opened/closed. When this type of stamp pad is used to apply a mark with a rubber stamp, the main body is placed flat on a desk or the like, and the side wall of the cover is pressed by the fingers so the cover can be lifted off to separate the cover from the main body. The rubber stamp is then lightly pressed onto the ink-absorbent member to pick up ink for printing on a paper sheet or other object to which the stamp mark is to be applied. After application of the stamp mark, the cover is replaced over the main body.

The conventional stamp pad is laid flat on the surface of a desk both when it is in use and when it is not in use. Consequently, the area occupied by the stamp pad is the flat area of the main body. When several plural stamp pads are provided, the area occupied by the stamp pads becomes large. In particular, when the stamp pads are not in use, the area occupied by the stamp pads, even by a single stamp pad, not to mention several stamp pads, can hamper operations.

BRIEF SUMMARY OF THE INVENTION

The present invention has focused on the idea that if the stamp pad is stood up, the area occupied by the stamp pad would be reduced. The present invention was achieved as a result.

The present invention provides a type of vertical stamp pad that occupies a smaller area when not in use.

That is, the present invention provides a type of vertical stamp pad characterized by the following facts: the stamp pad consists of a main body that comprises an ink-absorbent member and a cover; and the side portion of said main body has legs to allow the stamp pad to stand up.

The present invention can provide a type of vertical stamp pad that can stand up so that it occupies a smaller area when not in use.

DETAILED DESCRIPTION OF THE INVENTION

In general, the vertical stamp pad of the present invention consists of a main body that comprises an ink-absorbent member, and a cover, and has legs on the side portion of said main body to allow the stamp pad to stand upright. The main body and cover can be separable from each other. The legs can support the main body and hold it erect, and the cover can fit the main body. The stamp pad can stand obliquely. When the stamp pad stands upright, the angle between the bottom of the main body and the flat plane on which the legs rest can be in the range of 75-85°. The stamp pad can be laid down for use, and can be stood up when not in use.

EXAMPLES

In the following sections, the present invention will be explained in more detail with reference to application examples.

Example 1

The following is a specific explanation with reference to the enclosed figures.

Figure 1A:
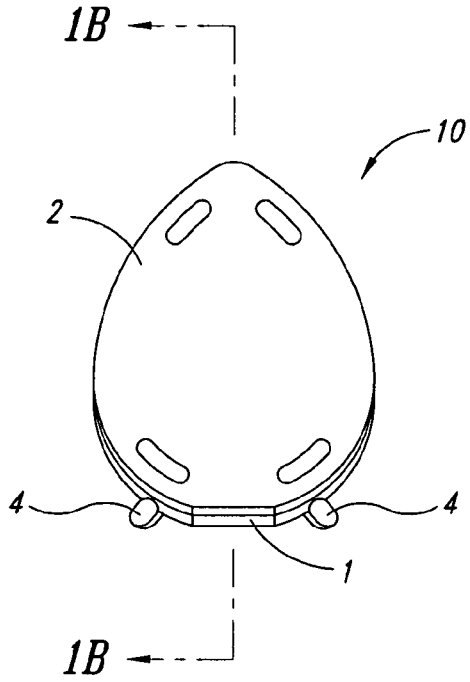
FIG. 1A is a top plan view illustrating an embodiment of the vertical stamp pad of the present invention.
Figure 1B:
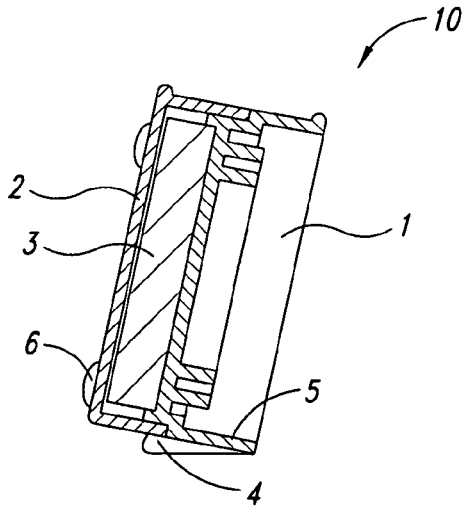
FIG. 1B is a cross-section of the stamp pad of FIG. 1A, viewed along section 1B-1B.
Figure 2:
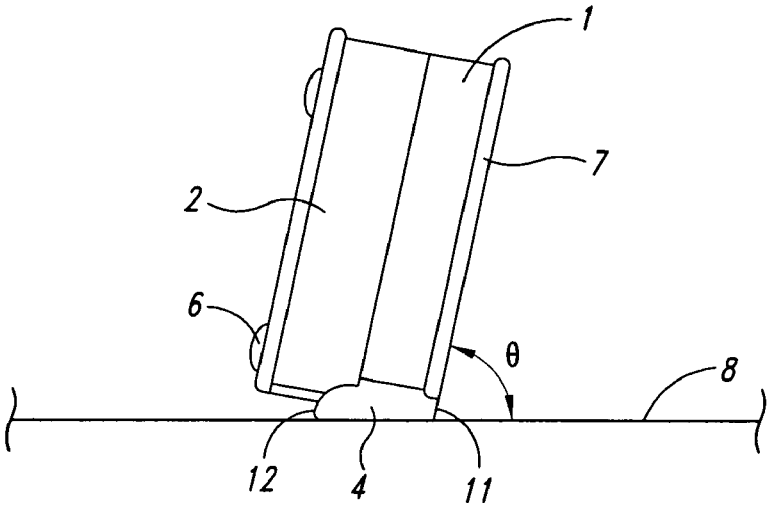
FIG. 2 is a side view illustrating an embodiment of the stamp pad of the present invention.

FIGS. 1A and 1B schematically illustrate an embodiment of the stamp pad of the present invention. FIG. 1A is a plan view, and FIG. 1B is a cross section taken across 1B-1B. FIG. 2 is a side view illustrating an embodiment of the stamp pad of the present invention.

As shown in FIGS. 1A, 1B and 2, a stamp pad 10 is composed of main body 1 that accommodates ink-absorbent member 3 and cover 2. Two legs 4 are provided on side portion 5 of main body 1 for erecting the stamp pad to stand upright. Reference number 6 represents a protrusion on the cover.

Legs 4 on main body 1 function to support main body 1 and hold it erect. Said main body 1 is fitted with cover 2. Said main body 1 and cover 2 can be separated from each other.

The stamp pad 10 can stand such that it inclines backward without falling down. More specifically, in the embodiment shown in FIG. 2, when the stamp pad is stood upright, bottom 7 of main body 1 and plane 8 on which two legs 4 rest form an angle θ in the range of 75-85°, or more preferably 80°.

Rear portion 11 on one side of leg 4 is formed coplanar with bottom 7 of main body 1. Front portion 12 of leg 4 is formed protruding forward so as to keep the stamp pad standing with high stability.

With regard to the shape of the stamp pad 10, any shape with a low center of gravity, so that the vertical stamp pad does not fall down when erected, can be adopted. For example, the shapes that can be adopted include the teardrop shape shown in FIG. 1A as well as a triangular shape, trapezoidal shape, square shape, elliptical shape, rectangular shape, etc.

The stamp pad 10 is laid down when it is to be used. When not in use, the vertical stamp pad can be stood upright.

Figure 3:
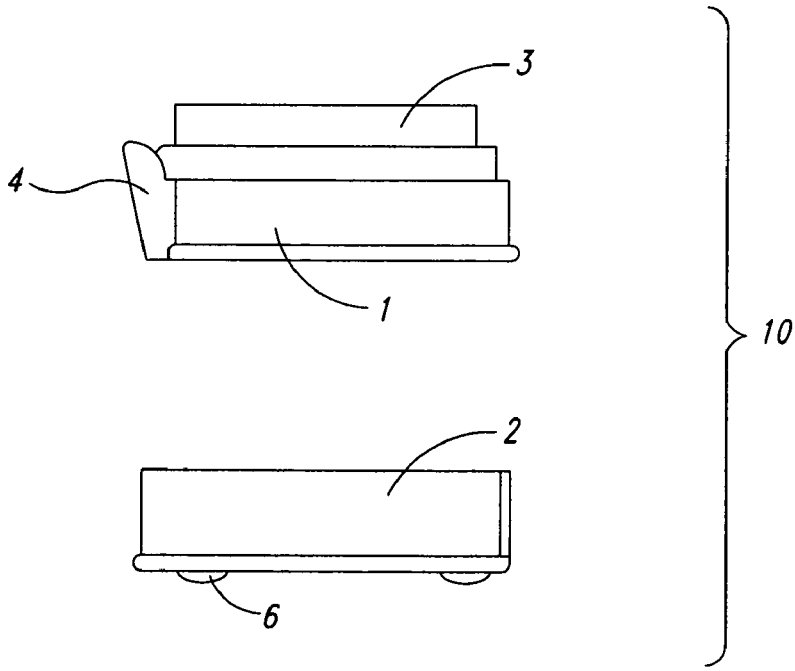
FIG. 3 is a side view illustrating an embodiment of the stamp pad of the present invention when it is in use.

FIG. 3 is a schematic diagram illustrating an embodiment in which the stamp pad 10 of the present invention is in use. The stamp pad 10 is laid down on a desk or the like for use. Said main body 1 rests on the plane, cover 2 is removed from main body 1, and the rubber stamp is lightly pressed against ink-absorbent member 3 in main body 1 to pick up ink. The rubber stamp is then pressed against a paper sheet or the like to apply the stamp mark.

When the stamp pad 10 is not in use, it can be stood up as shown in FIG. 2, so that the area occupied by the unused stamp pad can be reduced. In particular, when there are several stamp pads, the area occupied can be greatly reduced. The effect is significant.

By erecting the stamp pad 10 of the present invention when it is not in use, the area occupied by the stamp pad can be reduced. As a result, the stamp pad has a smaller footprint.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A stamp pad, comprising a main body housing an ink-absorbent member, and a cover; a side portion of said main body having legs adapted to allow the stamp pad to stand upright when not in use, the legs comprising at least one angled body protruding from the side portion of said main body, the angled body comprising a front portion, a rear portion and a support surface, wherein the rear portion of the angled body is substantially coplanar with a bottom surface of the main body, the front portion of the angled body extends outwardly and forwardly from the rear portion of the angled body, and an angle between the support surface and the bottom surface of the main body is in the range of 75-85 degrees.

2. The stamp pad of claim 1 wherein the cover fits over a portion of the main body.

3. The stamp pad of claim 1 wherein the legs are oriented such that the stamp pad stands upright obliquely.

4. The stamp pad of claim 1 wherein when the stamp pad is to be used, it can be laid down, and when it is not in use, it can be stood upright.

* * * * *